US007153001B2

(12) United States Patent
Kim

(10) Patent No.: US 7,153,001 B2
(45) Date of Patent: Dec. 26, 2006

(54) AUTO LIFT CEILING LIGHTING SYSTEM

(75) Inventor: Jong Yeol Kim, Busan (KR)

(73) Assignee: Hanil Company, Busan (KR)

( * ) Notice: Subject to any disclaimer, the term of this patent is extended or adjusted under 35 U.S.C. 154(b) by 246 days.

(21) Appl. No.: 10/806,144

(22) Filed: Mar. 23, 2004

(65) Prior Publication Data

US 2004/0218394 A1 Nov. 4, 2004

(30) Foreign Application Priority Data

May 3, 2003 (KR) ..... 20-2003-0013919

(51) Int. Cl.
*F21V 21/36* (2006.01)

(52) U.S. Cl. ..... 362/291; 362/404; 362/407; 362/428

(58) Field of Classification Search ..... 362/391, 362/404, 407, 428; 191/12.2 A
See application file for complete search history.

(56) References Cited

U.S. PATENT DOCUMENTS 6,669,135 B1 * 12/2003 Hartley ..... 242/390.9
6,837,340 B1 * 1/2005 Strauss et al. ..... 187/413

FOREIGN PATENT DOCUMENTS

| | | | |
|---|---|---|---|
| DE | 29807516 U1 | * | 10/1998 |
| KR | 20-0279728 Y1 | | 6/2002 |
| KR | 20-0304795 Y1 | | 2/2003 |

* cited by examiner

*Primary Examiner*—Ali Alavi
*Assistant Examiner*—Hargobind S. Sawhney
(74) *Attorney, Agent, or Firm*—Birch, Stewart, Kolasch, and Birch, LLP

(57) ABSTRACT

An auto lift ceiling lighting system in which the width of left and right rotary drums is formed as wide as the width of the flat cable and the flat cable is wound stably and vertically on the outer surface of the winding core in the left and right rotary drums so as not to become twisted. In the auto lift ceiling lighting system, the lamp can be turned on and off at any position and the flat cable supplying the electric power to the lamp does not become twisted and the balance of the lamp is maintained while the lamp ascends and descends.

7 Claims, 9 Drawing Sheets

AUTO LIFT CEILING LIGHTING SYSTEM

The present application claims priority on Korean Utility Model Application No. 20-2003-0013919 filed in Korea on May 3, 2003, the entire contents of which are hereby incorporated by reference.

BACKGROUND OF THE INVENTION

1. Field of the Invention

The present invention relates to an auto lift ceiling lighting system, and in particular to an auto lift ceiling lighting system, which can get a lamp to be turned on and off at any position while the lamp ascends and descends, and which comprises a flat cable composed of an electric supply wire and two stainless wires enduring the weight of the lamp and preventing a fall, a device preventing twist of the flat cable and rotary drums on both sides of the coaxial shaft of the motor to keep the balance of the lamp and the smooth lifting operation.

2. Discussion of the Related Art

In general, as shown in Korean Utility Model Application No. 20-2002-0009076, a prior art ceiling lift lighting system comprises a motor 201 for lifting operation of the lamp, more than two winches 202 installed on a coaxial shaft of the motor, wires 203 winded on the said winches 202, a stopping device 208 controlling upper and lower limit of the position of the lamp in proportion to the number of the revolutions of the winches 202, an anti-twisting ball 204 connected to the end of the wire 203, a ballast box 205 fixed on the lamp 200, balancing devices 206 combined with the upper side of the ballast box 205 to keep balance of the lamp 200, bumpers 210 installed in the inner part of the balancing devices 206 to absorb the shock when the lamp makes contact with the terminal 209 on lower side of a motor case 207.

The said conventional art is similar to the present invention in point of the function that the auto lift ceiling lighting system prevent the lamp from a fall even though one of the wires is cut, as at least two winches are installed on the coaxial shaft of the motor and wires connected with the lamp are winded on each of the winches. But in the conventional art, the lamp cannot be turned on and off at every position we want.

For example, in a factory or a gymnasium where the only one light set consisting of three lamps exists, when one of the lamps is out of order, the light set should be taken down for repair. At this time, all the lamps are turned off because the terminal on the upper part of the ballast box is separated from the terminal in the lower part of the motor case. If this kind of situation happens at night, another lighting devices would be required. Moreover it cannot be used in the place where the height of the lamp should be controlled according to the working environment in a factory of manufacturing industry or to the kind of event in a gymnasium or an auditorium.

In addition, in point of preventing the twist of the wire rolled on a winding reel similarly to the object of preventing the twist of the flat cable supplying the electric power to the lamp among the objects of the present invention, because the width of winding reel of the more than two winches installed on the coaxial shaft of the motor is formed widely, there is no problem in case that each wire rolled respectively on the said two winding reels is winded regularly in the coaxial horizontal direction of the two winding reel. But if the wire is not winded regularly but winded doubly or triply over the wire rolled on the winding reel or winded in a tangle, the lamp in which more than two lamps are installed cannot keep the balance and inclines to the left or right, hereby the wire can be cut.

As shown in another related art, i.e., Korean Utility Model Application No. 20-2002-0033396, the wire combination structure of the said lift lighting system comprises a wire 304 having a rope 301, a grounding wire 302 and electric power supply wires 303 in an outer cover 300; a winding reel 306 on which the wire 304, at the end of which the lamp is installed, is rolled, and on one side of which pulleys 305 and 308 is installed; a power supply part 307 in which the pulley 305 is installed on the shaft of the motor 312 to operate the winding reel 306; belt 309 connecting the pulley 305 of the power supply part with the pulley 308 of the winding reel; a bracket 311 fixing the winding reel 306 to the frame 310.

In the wire combination structure of the said conventional art, because the rope 301, the grounding wire 302 and the electric power supply wires 303 are combined in one wire, there can be a fall of the lamp owing to the rotation or twist of the lamp itself or the weight of the lamp.

In addition, because the width of the winding reel on which a wire is rolled is wide, in case the wire is not rolled regularly on the horizontal direction but is twisted doubly or triply, the lamp itself can be rotated or twisted.

And in case that the lamp is lifted up and down by two wires to solve the said problem, the balance of the lamp cannot be kept due to the winding error and the difference of the winding speed.

SUMMARY OF THE INVENTION

Accordingly, the present invention is directed to an auto lift ceiling lighting system that substantially obviates one or more of problems due to limitations and disadvantages of the related art.

An object of the present invention is to provide an improved auto lift ceiling lighting system in which a lamp can be turned on and off at any position while being raised and lowered, and which can endure the weight of the lamp thereby preventing a fall, and which can maintain the balance of the lamp for smoothly lifting it up and down without shaking, thereby preventing the twisting of the wire and of the lamp itself.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an auto lift ceiling lighting system comprises a motor part for lifting the lamp up and down; rotary drum parts installed on the coaxial shaft of both sides of the motor part, the rotary drum part having a winding core which has a passage hole formed inside part of the winding core and an insertion hole formed on a part of the circumferential surface of the winding core and formed parallel to the central axis of the winding core. The winding core is separated by the passage hole and the insertion hole; flat cables are wound on the rotary drum parts, the flat cable being formed in a flat and even distribution and composed of an electric wire of net form in the center of the soft PVC flat and stainless wires for enduring the weight of the lamp in both sides of the electric wire; power supply parts supplying electric power to the flat cables, the power supply part comprising a brush electrode connected with the flat cable and an insulator for preventing the electrical current from flowing from the brush electrode to the conductor of the left and right rotary drums and a brush supplying the electric power to the brush electrode and a brush holder for supporting the brush and a brush holder supporter supporting the brush holder. One side of the brush electrode is formed in the shape of circular plane surface and the other side is formed in the shape of the male screw which connects a bolt with a terminal connected with the flat cable. The said terminal connects and fixes the electrical wire of the flat cable inserted into the winding core; a body cover part which fixes the motor part, the rotary drum parts and the power supply part; a ballast for stabilizing the electricity supplied to the lamp, the ballast being installed below the body cover; a ballast box in which the ballast is installed; a lever the center of which is connected with the center of gravity of the ballast box, both ends of which are connected with the flat cables in the ballast box.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiment of the present invention, which is illustrated in the accompanying drawings.

Figure 1:
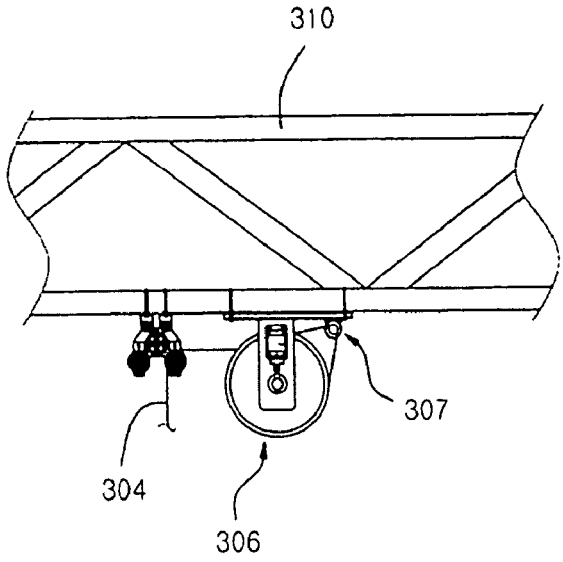
FIG. 1 RELATED ART
FIG. 1 is a side view illustrating a ceiling lift lighting system according to the related art.
Figure 2:
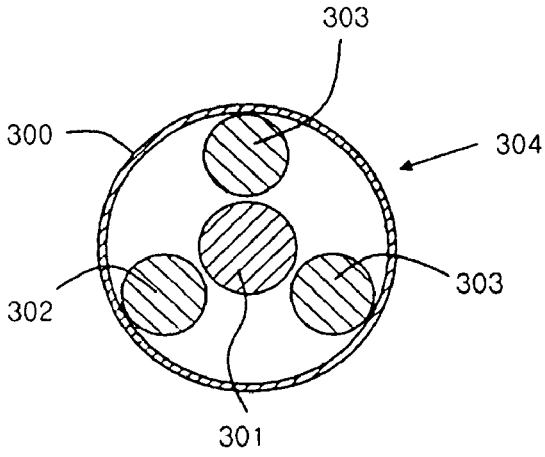
FIG. 2 RELATED ART
FIG. 2 is a cross-sectional view illustrating a wire combination structure of the related art.
Figure 3:
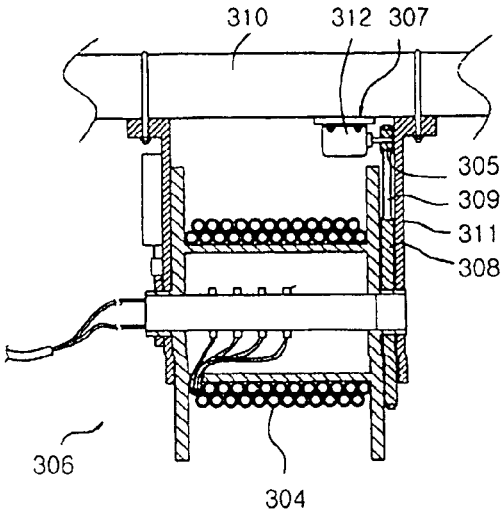
FIG. 3 RELATED ART
FIG. 3 is a schematic cross-sectional view illustrating a winding reel of the related art.
Figure 4:
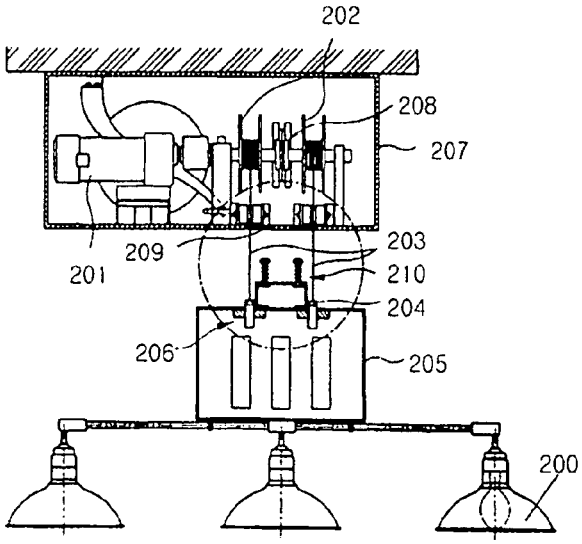
FIG. 4 RELATED ART
FIG. 4 is a front view illustrating a ceiling lift lighting system according to the related art.
Figure 5:
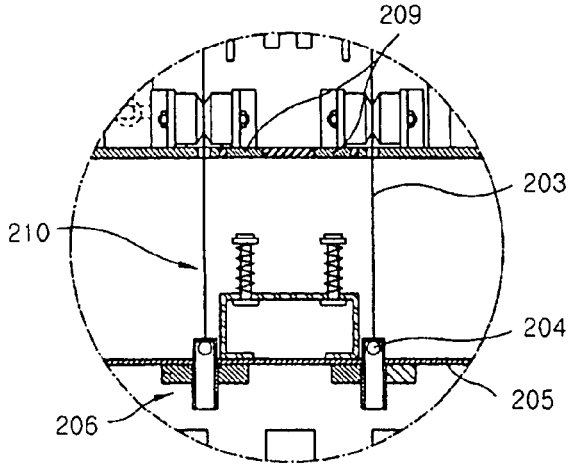
FIG. 5 RELATED ART
FIG. 5 is an enlarged view illustrating the part shown in dotted line of FIG. 4.
Figure 6:
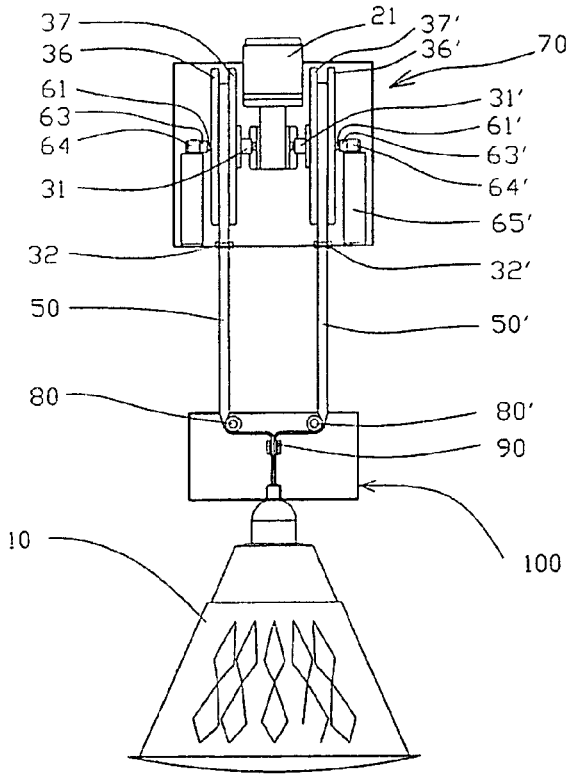
FIG.6 is a front view illustrating an auto lift ceiling lighting system according to the present invention.
Figure 7:
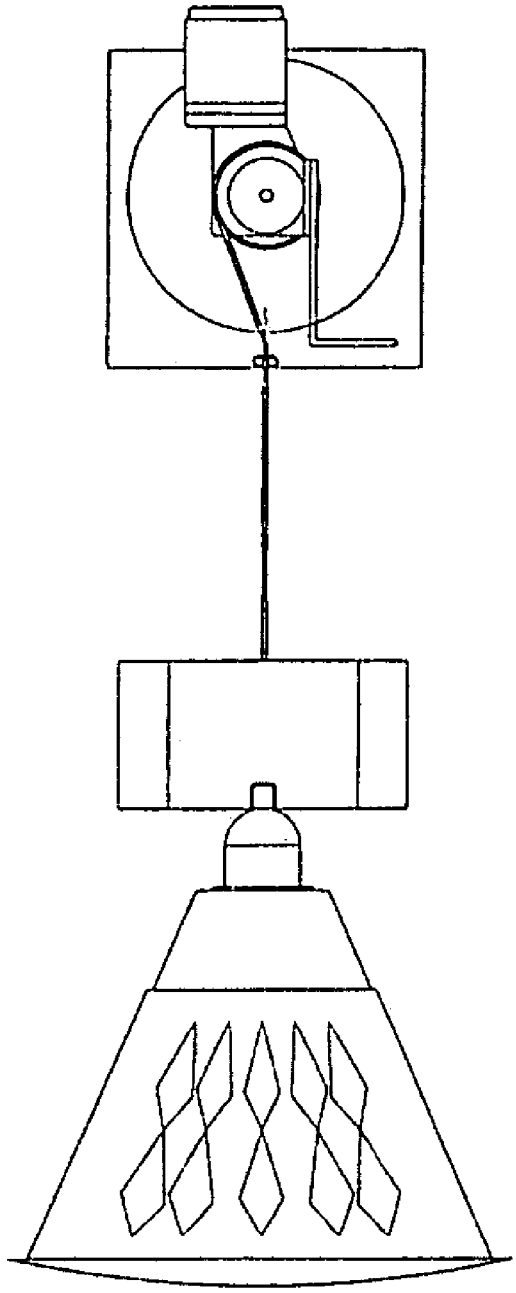
FIG. 7 is a side view illustrating an auto lift ceiling lighting system according to the present invention.
Figure 8:
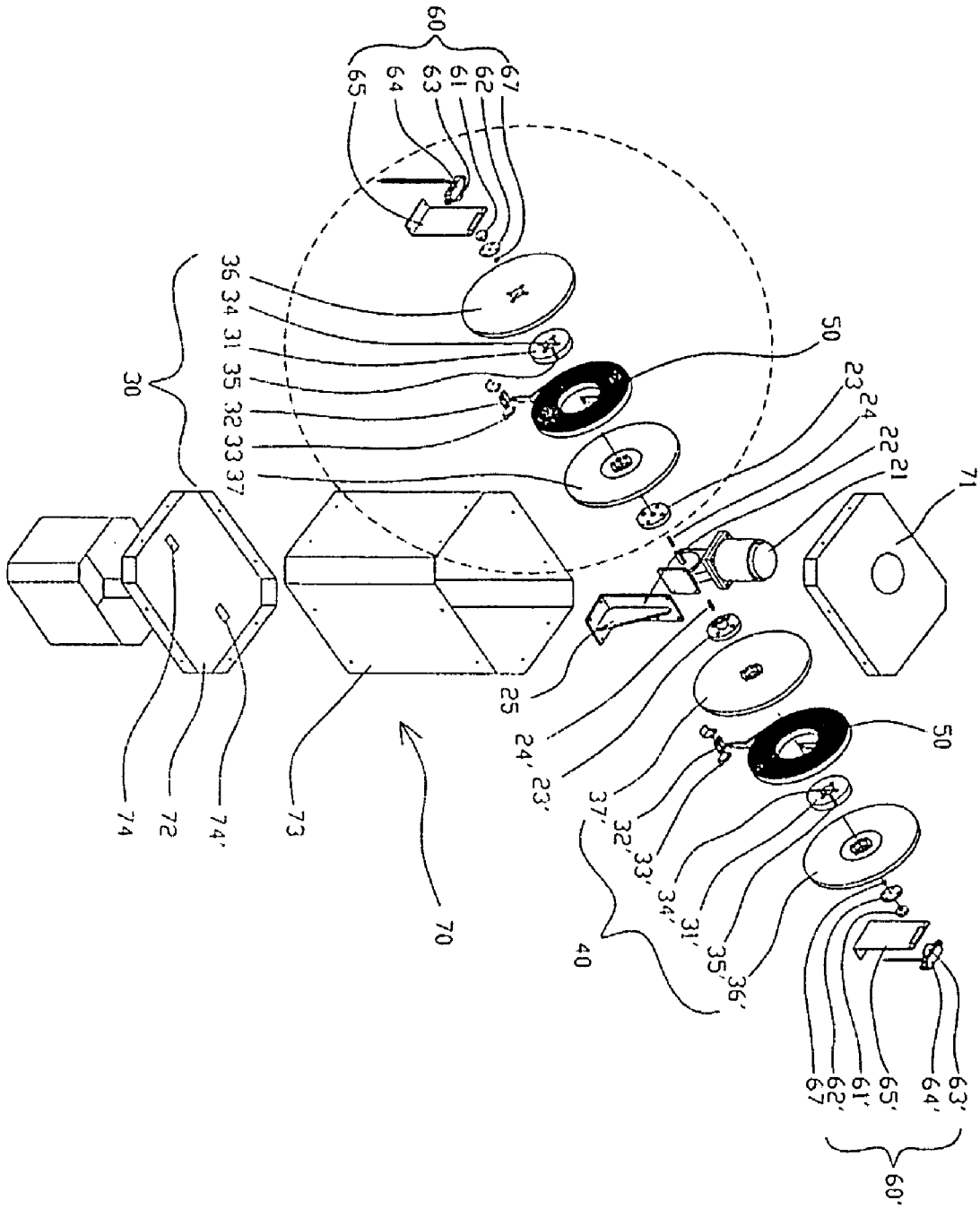
FIG. 8 is an exploded view illustrating an auto lift ceiling lighting system according to the present invention.
Figure 9:
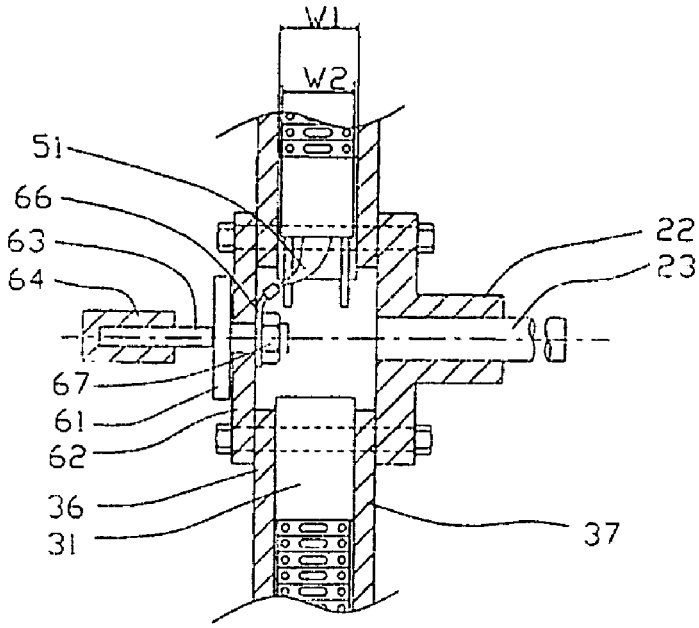
FIG. 9 is a schematic cross-sectional view illustrating an assembly of the part shown in dotted line of FIG. 8.
Figure 10:
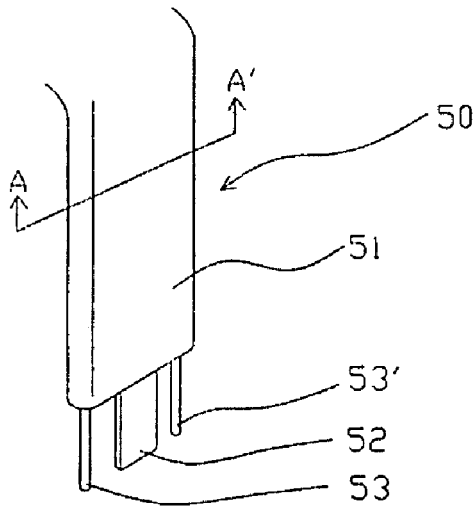
FIG. 10 is a perspective view illustrating a flat cable of the present invention.
Figure 11:
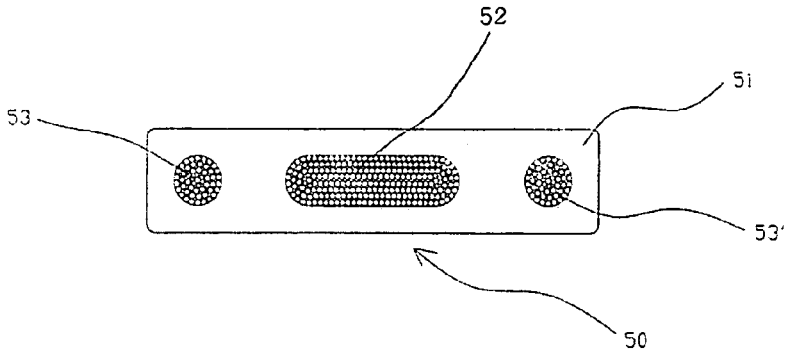
FIG. 11 is a cross-sectional view of A–A' of FIG. 10.
Figure 12:
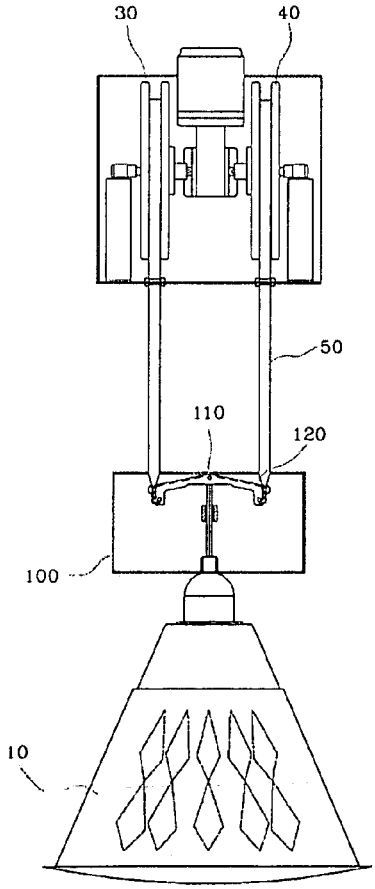
FIG. 12 is a front view illustrating an auto lift ceiling lighting system according to another embodiment of the present invention, FIG. 13 provides an exploded view of the portion of FIG. 8 shown in dotted lines.
Figure 13:
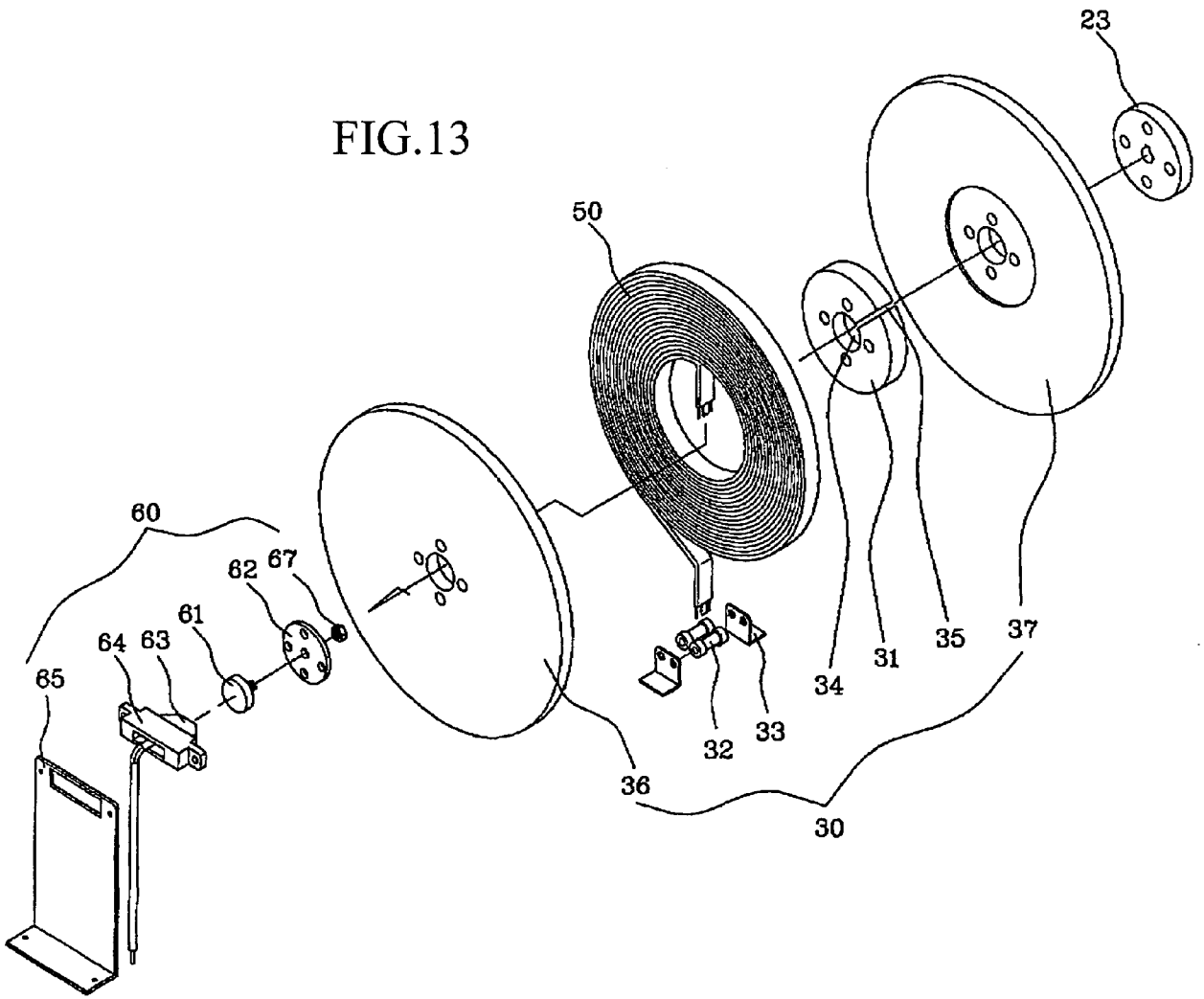
Figure 14:
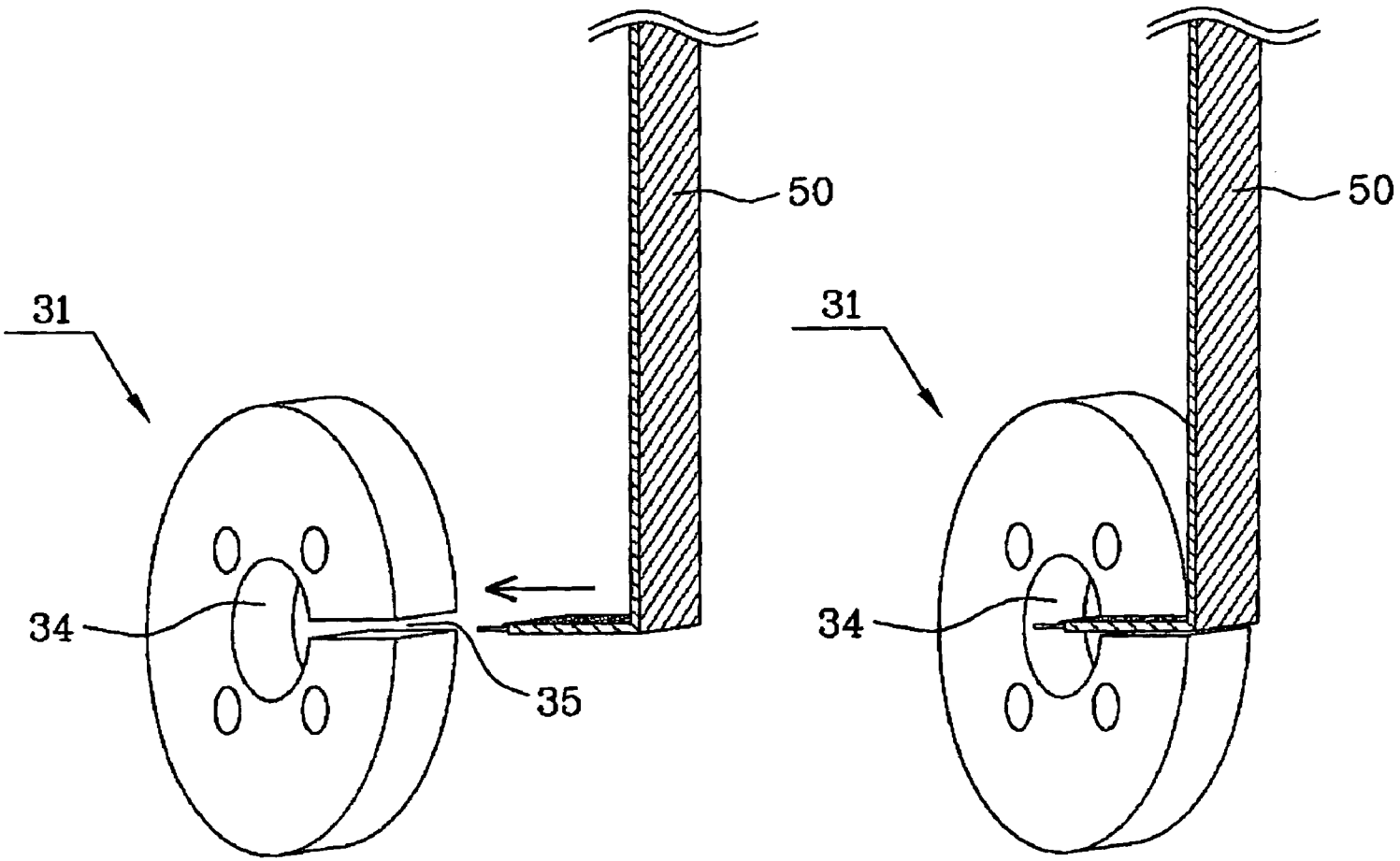
FIG. 14 shows, in detail, the combination of the winding cove and the flat cable.

FIG.6 is a front view illustrating an auto lift ceiling lighting system according to the present invention, FIG. 7 is a side view illustrating an auto lift ceiling lighting system according to the present invention, FIG. 8 is an exploded view illustrating an auto lift ceiling lighting system according to the present invention, FIG. 9 is a schematic cross-sectional view illustrating an assembly of the part shown in dotted line of FIG. 8, FIG. 10 is a perspective view illustrating a flat cable of the present invention, FIG. 11 is a cross-sectional view of A–A' of FIG. 10, and FIG. 12 is a front view illustrating an auto lift ceiling lighting system according to another embodiment of the present invention.

As shown in the figures, the auto lift ceiling lighting system comprises a motor part for lifting a lamp 10 up and down; rotary drum parts comprising a left rotary drum 30 and right rotary drum 40 which are coaxially installed on the shaft at both sides of the motor part; flat cables 50 and 50' winded on the outer surface of winding cores 31 and 31' which is installed on the inside of the left and right rotary drums 30 and 40 respectively; power supply parts 60 and 60' which are installed on outer rotary drums 36 and 36' of the left and right rotary drums 30 and 40 and supply the electric power to the flat cables 50 and 50'; a body cover part 70 in which the motor part, rotary drum parts, the flat cables 50 and 50', and power supply parts 60 and 60' are combined together and fixed; and a ballast box comprising a ballast which is installed below the body cover part 70 and stabilizes the electricity supplied to the lamp 10, guide rollers 80 and 80' which guide flat cables 50 and 50' pulled down from the left and right rotary drums 30 and 40 and a gathering roller 90 which gathers the flat cables 50 and 50' guided by the guide rollers.

Especially, the left and right rotary drums 30 and 40' comprises winding cores 31 and 31' on which flat cables 50 and 50' are winded, rollers 32 and 32' for supporting the flat cables 50 and 50' of the lamp so as not to become rotated or twisted, and roller supporter 33 and 33' installed on a lower cover of the body cover part 70 to support the rollers 32 and 32'.

A lever 120 is installed in the ballast box 100 which is located at the upper side of the lamp, so that the balance of the lamp can be maintained.

The lever 120 has a center 110 which is combined with the center of gravity of the ballast box 100. The flat cables 50 and 50' are connected to the respective ends of the lever 120. And the leverage of the lever 120 absorbs the vibration of the lamp 10 due to the difference in the winding speed or an error in the-winding of the flat cables 50 and 50', whereby the balance of the lamp 10 is maintained when the lamp 10 is raised and lowered. The removal of the vibration provides an observer under the lamp 10 with a sense of stability because shaking of the light is prevented while the lamp 10 is raised and/or lowered in the "on" position.

The winding cores 31 and 31' have respectively passage holes 34 and 34' formed inside part of the winding core and insertion holes 35 and 35' formed on a part of the circumferential surface of the winding core 31 and 31' and formed parallel to the central axis of the winding cores 31 and 31', and the winding cores 31 and 31' are respectively separated by the passage holes 34 and 34' and the insertion holes 35 and 35'. The flat cables 50 and 50' are inserted into the passage holes 34 and 34' via the insertion hole and connected to brush electrodes 61 and 61'. The flat cables 50 and 50' for supplying electrical power to the lamp 10 are winded on the outer surface of the winding cores 31 and 31' of the left and right rotary drums 30 and 40.

The width W1 of the left and right rotary drums 30 and 40 of the rotary drum parts is formed to be as wide as the width W2 of the flat cables 50 and 50'. More ideally, the width W1 of the left and right rotary drums 30 and 40 is formed about 1 mm wider than the width W2 of the flat cables 50 and 50'. Then the flat cables 50 and 50' are wound stably on the outer surface of the winding cores 31 and 31' of the left and right rotary drums 30 and 40 by a motor 21, and the flat cables 50 and 50' are wound with both sides of the flat cables 50 and 50' adjoining the outer rotary drums 36 and 36' and the inner drums 37 and 37' of the rotary drum parts. The flat cables 50 and 50' are wound on the outer surface of the winding cores 31 and 31' which are inside of the left rotary drum 30 and the right rotary drum 40, so that the flat cables 50 and 50' do not become twisted.

The body cover part 70 includes an-upper cover 71 which is provided with an aperture through which the housing of the motor 21 extends so that the vibration of the motor 21 may be absorbed and the heat generated from the motor 21 may be dissapated. A lower cover 72 is provided on which the motor part 20, rotary drum parts, flat cables 50 and 50' and the power supply parts 60 and 60' are combined and installed. A body cover 73 connect the upper cover 71 with the lower cover 72. The lower cover 72 has paths 74 and 74' which allow the flat cables 50 and 50' connected with the lamp 10 to smoothly move up and down smoothly.

The power supply parts 60 and 60' comprises brush electrodes 61 and 61' connected with the flat cables 50 and 50' which are connected with the lamp 10 and extend through the insertion holes 35 and 35' of the winding core 31 and 31' of the rotary drum parts and into the passage holes 34 and 34. Insulators prevent the electric current from flowing from brush electrodes 61 and 61' to conductors of the left and right rotary drums 30 and 40. Brushes 63 and 63' supply the electric power to the brush electrodes 61 and 61'. Brush holders 64 and 64' supporting the brushes 63 and 63'; and brush holder supporters 65 and 65'.

One side of the brush electrodes 61 and 61' is formed in the shape of a circular plane surface and the other side of the brush electrodes 61 and 61' is formed in the shape of a male screw which connects nuts 67 and 67' with terminals 66 and 66' connecting the brush electrodes 61 and 61' with the electric wire 52 of the flat cables 50 and 50'. The terminals 66 and 66' are connected with the electric wire 52 of the flat cables 50 and 50' inserted into the winding cores 31 and 31'.

In addition, drum housings 23 and 23' combined with a horizontal shaft 22 at both sides of the motor 21. Inner rotary drums 37 and 37' of the left and right rotary drums 30 and 40 combined with the drum housings 23 and 23'. Connection pins 24 and 24' connect the drum housings 23 and 23' with the motor 21, and a motor supporter 25 support the motor 21.

4 holes penetrate the insulators 62 and 62'. The left and right rotary drums 30 and 40, the winding cores 31 and 31', and the drum housings 23 and 23' are combined with bolts to form one body on the horizontal shaft 22 at both sides of the motor 21 and rotate as a body by the operation of the motor 21.

The flat cable 50 comprises electrical wire 52 with a net configuration disposed in the center of a soft PVC flat portion 51 and stainless wires 53 and 53' are provided for withstanding the weight of the lamp 10 in both sides of the electric wire 52.

As stated above, the auto lift ceiling lighting system of the present invention can turn the lamp on and off at any position and can endure the weight of the lamp to prevent it form falling as well as maintaining-the balance of the lamp while the lamp is raised and lowered. The auto lift ceiling lighting system also prevents twisting while the lamp ascends and descends.

It will be apparent to those skilled in the art that various modifications and variations can be made in the fabrication and application of the present invention without departing from the spirit or scope of the invention. Thus, it is intended that the present invention cover the modifications and variations of this invention provided they come within the scope of the appended claims and their equivalents.

What is claimed is:

1. An auto lift ceiling lighting system comprising:

a motor part providing a lifting operation of a lamp;

rotary drums formed on both side of the coaxial shaft of the motor part;

flat cables for supplying electrical power to the lamp, the flat cables wound on winding cores of the respective rotary drums;

power supply parts for supplying the electrical power to the flat cables;

a body cover part housing the motor part, the rotary drums, and the power supply parts;

a ballast for stabilizing the electricity supplied to the lamp, the ballast being installed below the body cover part; and a ballast box in which the ballast is installed, wherein the width of the rotary drums is formed as wide as the width of the flat cables and the flat cables are wound stably and vertically on the winding cores of the rotary drums when wound by the motor, so as not to become twisted, wherein the winding core has a passage hole formed on the inside part of the winding core and an insertion hole formed on a part of the circumferential surface of the winding core and parallel to the central axis of the winding core, and the winding core is separated by the passage hole and the insertion hole for the flat cable to be inserted into the passage hole via the insertion hole and connected to a brush electrode.

2. The auto lift ceiling lighting system m according to claim 1, wherein the flat cable comprises the electrical wire in net form disposed in the center of the soft PVC flat and stainless wires for enduring the weight of the lamp at both sides of the electrical wire.

3. The auto lift ceiling lighting system according to claim 2, wherein the flat cable is formed flatly and evenly, so that the volume of the wound flat cable is small.

4. The auto lift ceiling lighting system according to claim 3, wherein the flat cable is formed flatly and evenly, so that the volume of the wound flat cable is small.

5. An auto lift ceiling lighting system comprising:

a motor part providing a lifting operation of a lamp;

rotary drums formed on both side of the coaxial shaft of the motor part;

flat cables for supplying electrical power to the lamp, the flat cables wound on winding cores of the respective rotary drums;

power supply parts for supplying the electrical power to the flat cables;

a body cover part housing the motor part, the rotary drums, and the power supply parts;

a ballast for stabilizing the electricity supplied to the lamp, the ballast being installed below the body cover part; and a ballast box in which the ballast is installed, the width of the rotary drums is formed as wide as the width of the flat cables and the flat cables are wound stably and vertically on the winding cores of the rotary drums when wound by the motor, so as not to become twisted, a brush electrode connected with the flat cable, one end of the flat cable being connected with the lamp and the other end of the flat cable goes through an insertion hole to be inserted into a passage hole;

an insulator for preventing the electrical current from flowing from the brush electrode to the conductor of the left and right rotary drums;

a brush for supplying the electrical power to the brush electrode;

a brush holder for supporting the brush; and a brush holder supporter for supporting the brush holder.

6. The auto lift ceiling lighting system according to claim 5, wherein one side of the brush electrode is formed in the shape of a circular plane surface and the other side is formed in the shape of the male screw, the male screw connecting the brush electrode to a terminal connected to an electrical wire of the flat cable in combination with a nut, said terminal connecting the electrical wire of the flat cable inserted into the winding core to the brush electrode.

7. An auto lift ceiling lighting system comprising:

a motor part providing a lifting operation of a lamp;

rotary drums formed on both side of the coaxial shaft of the motor part;

flat cables for supplying electrical power to the lamp, the flat cables wound on winding cores of the respective rotary drums;

power supply parts for supplying the electrical power to the flat cables;

a body cover part housing the motor part, the rotary drums, and the power supply parts;

a ballast for stabilizing the electricity supplied to the lamp, the ballast being installed below the body cover part; and a ballast box in which the ballast is installed, the width of the rotary drums is formed as wide as the width of the flat cables and the flat cables are wound stably and vertically on the winding cores of the rotary drums when wound by the motor, so as not to become twisted, wherein the flat cables are connected with the both ends of a lever in the ballast box, and respectively the center of the levers is connected with the center of gravity of the ballast box, so that the leverage of the lever absorbs the vibration of the lamp due to the difference of the winding speed or an error of winding the flat cables, whereby the balance of the lamp is maintained when the lamp ascends and descends.

* * * * *